US008869532B2

(12) United States Patent
Datye

(10) Patent No.: US 8,869,532 B2
(45) Date of Patent: Oct. 28, 2014

(54) STEAM TURBINE UTILIZING IP EXTRACTION FLOW FOR INNER SHELL COOLING

(71) Applicant: General Electric Company, Schenectady, NY (US)

(72) Inventor: Akshay Arvind Datye, Bangalore (IN)

(73) Assignee: General Electric Company, Schenectady, NY (US)

( * ) Notice: Subject to any disclaimer, the term of this patent is extended or adjusted under 35 U.S.C. 154(b) by 389 days.

(21) Appl. No.: 13/751,593

(22) Filed: Jan. 28, 2013

(65) Prior Publication Data

US 2014/0208747 A1 Jul. 31, 2014

(51) Int. Cl.
*F01K 7/34* (2006.01)
*F01K 7/22* (2006.01)

(52) U.S. Cl.
USPC ..... 60/653; 60/679; 415/93

(58) Field of Classification Search
USPC ..... 60/653, 677–680; 415/93, 100, 107
See application file for complete search history.

(56) References Cited

U.S. PATENT DOCUMENTS

| | | | | | |
|---|---|---|---|---|---|
| 2,823,891 | A * | 2/1958 | Baker et al. | ..... | 415/93 |
| 3,206,166 | A * | 9/1965 | Beldecos et al. | ..... | 415/93 |
| 4,550,569 | A * | 11/1985 | Isa et al. | ..... | 60/657 |
| 5,749,228 | A * | 5/1998 | Shiga et al. | ..... | 60/679 |
| 6,269,645 | B1 * | 8/2001 | Yamaguchi | ..... | 60/653 |
| 7,484,926 | B2 | 2/2009 | Suga et al. | | |
| 7,651,318 | B2 | 1/2010 | Suga et al. | | |
| 2004/0261417 | A1 * | 12/2004 | Yamashita et al. | ..... | 60/679 |
| 2012/0128474 | A1 | 5/2012 | Roy et al. | | |

* cited by examiner

*Primary Examiner* — Hoang Nguyen
(74) *Attorney, Agent, or Firm* — Nixon & Vanderhye P.C.

(57) ABSTRACT

A steam circuit is defined in a multi-section single shaft turbine. A hot reheat steam is input to a section of the multi-section turbine. A first flow path flows the hot reheat steam from an upstream side through the section of the multi-section turbine to a downstream side to create work. A second flow path directs a portion of the flow back toward the upstream side in the section of the multi-section turbine between an outer shell and an inner shell of the turbine. The effective shell cooling provides for increased main and reheat steam temperatures to improve performance. The system reduces the extraction steam flow required to meet the design final feedwater temperatures and allows more steam to expand through the low pressure section.

15 Claims, 3 Drawing Sheets

STEAM TURBINE UTILIZING IP EXTRACTION FLOW FOR INNER SHELL COOLING

BACKGROUND OF THE INVENTION

The invention relates to steam turbines and, more particularly, to a steam turbine utilizing IP extraction flow for inner shell cooling.

Steam turbines are often used for large power systems having a steam turbine and a steam generating source. The source may come in the form of single or multiple gas turbines coupled with single or multiple heat recovery steam generators or a coal fired boiler or a nuclear reactor. The steam turbine and source(s) drive an electrical generator as the load. Many arrangements for steam turbines in a power plant have been proposed. In a steam turbine thermal cycle, the hot exhaust gas from a combustion gas turbine or coal combustion in a boiler or fission reaction in a nuclear reactor contributes heat energy to partially or wholly generate the steam used in the steam turbine.

A steam turbine is a mechanical device that extracts energy from pressurized steam and converts the energy into work. Steam turbines receive a steam flow at an inlet pressure through multiple stationary nozzles that direct the steam flow against buckets rotationally attached to a rotor of the turbine. The steam flow impinging on the buckets creates a torque that causes the rotor of the turbine to rotate, thereby creating a useful source of power for turning an electrical generator or the like. The steam turbine includes, along the length of the rotor, multiple pairs of nozzles (or fixed blades) and buckets. Each pair of nozzle and bucket is called a stage. Each stage extracts a certain amount of energy from the steam flow causing the steam pressure to drop and the specific volume of the steam flow to expand.

Generally, a steam turbine has multiple extractions from its steam path. Extractions are used in feedwater heaters to improve the cycle heat rate. With reference to FIG. 1, typically, the extraction from IP exhaust 12 is provided to a feedwater heater 14. It would be desirable to recover the waste heat from the inner shell to thereby improve steam turbine performance.

BRIEF DESCRIPTION OF THE INVENTION

In an exemplary embodiment, a steam turbine includes a high pressure (HP) section, an intermediate pressure (IP) section downstream of the high pressure section, and a low pressure (LP) section downstream of the intermediate pressure section. The HP and IP sections may be included in a single outer shell or separate outer shell. A steam circuit is defined through the high pressure, intermediate pressure, and low pressure sections. The steam circuit includes a hot reheat steam input to the intermediate pressure section, a first flow path flowing the hot reheat steam from an HP side through the intermediate pressure section to an LP side to create work, and a second flow path that directs a portion of the flow back toward the HP side in the HP and IP sections between an outer shell and an inner shell of the turbine.

In another exemplary embodiment, a steam circuit through a multi-section single shaft turbine includes a hot reheat steam input to a section of the multi-section turbine, a first flow path flowing the hot reheat steam from an upstream side through the section of the multi-section turbine to a downstream side to create work, and a second flow path that directs a portion of the flow back toward the upstream side in the section of the multi-section turbine between an outer shell and an inner shell of the turbine.

In yet another exemplary embodiment, a method of cooling an inner shell in a steam turbine using IP extraction flow includes the steps of directing a hot reheat steam input to an intermediate pressure section of the turbine; flowing the hot reheat steam via a first flow path from an HP side through the intermediate pressure section to an LP side to create work; and directing the flow via a second flow path back toward the HP side in the intermediate pressure section between an outer shell and the inner shell of the turbine.

DETAILED DESCRIPTION OF THE INVENTION

Figure 1:
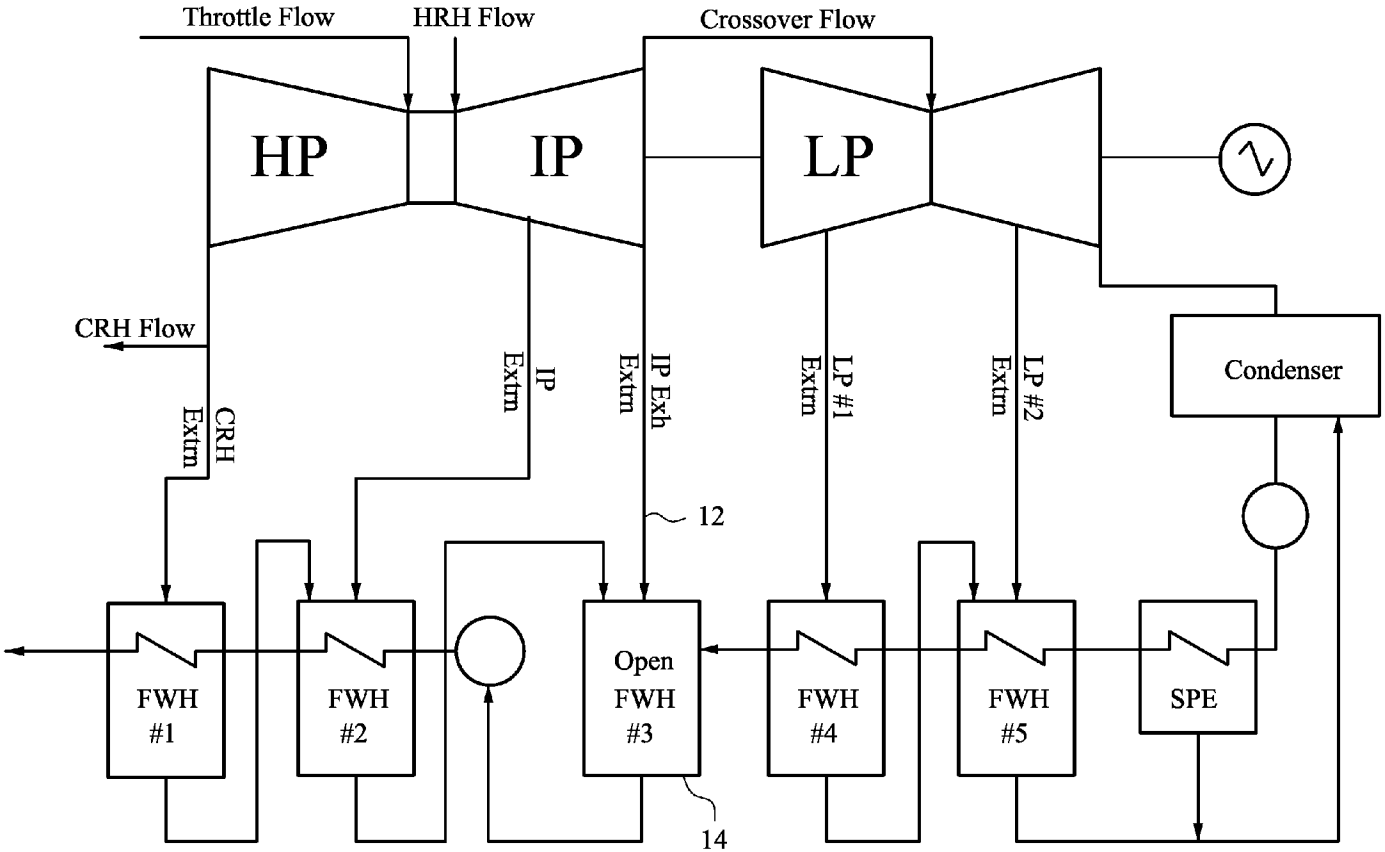
FIG. 1 is a schematic illustration of a typical steam turbine cycle.
Figure 2:
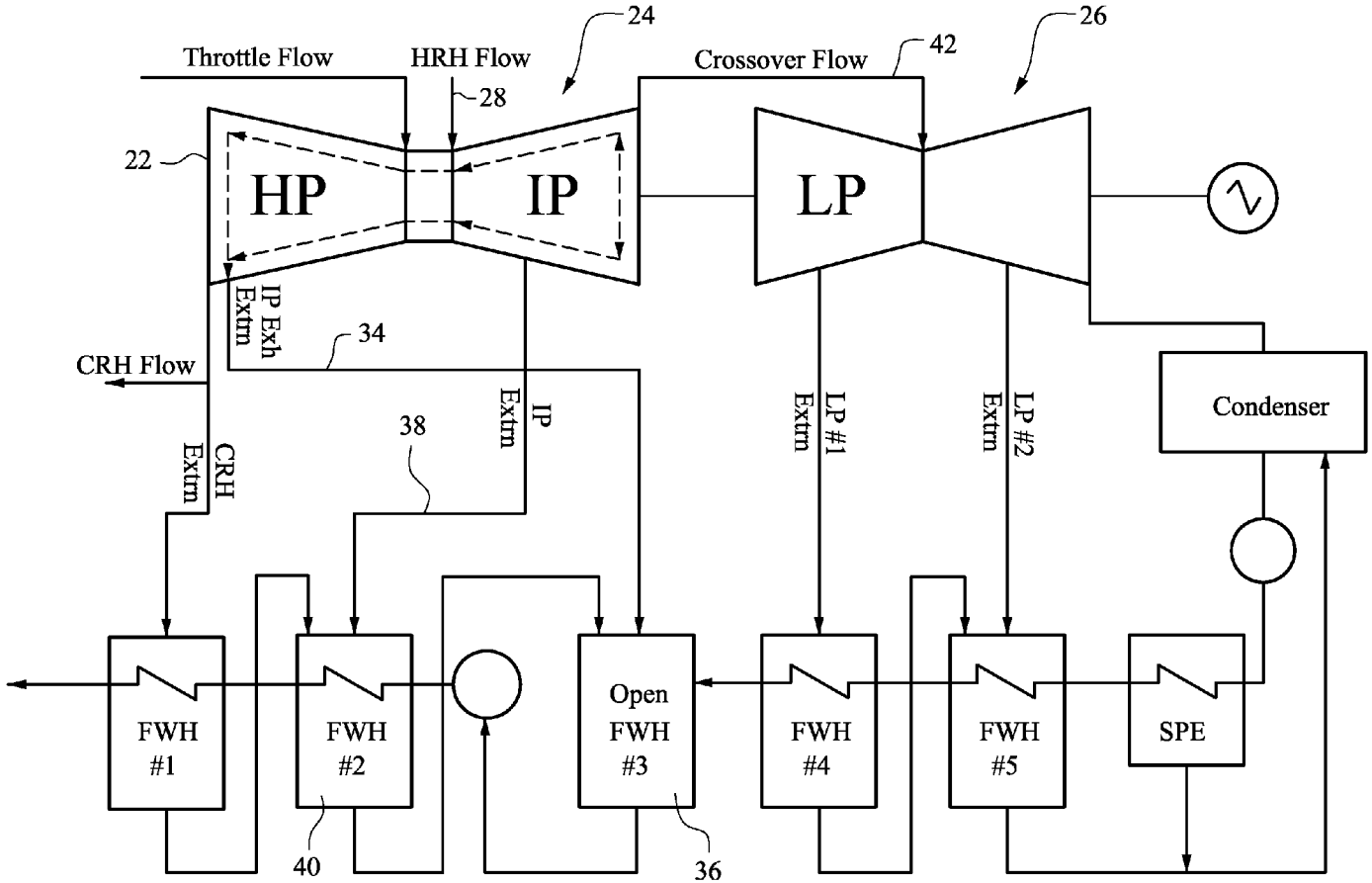
FIG. 2 is a schematic illustration of a steam turbine cycle that utilizes IP extraction flow for inner shell cooling.

FIG. 2 is a schematic illustration of a steam turbine cycle according to preferred embodiments. Generally, a boiler, a heat recovery steam generator (HRSG), or a nuclear reactor is coupled to a steam turbine-generator. Steam is produced in the boiler, HRSG or nuclear reactor and flows through a steam pipe or the like to a high pressure section 22 of the turbine. The boiler, HRSG or nuclear reactor produces heat to convert water into steam used to drive the turbine.

Exhaust from the high pressure section 22 is reheated in the boiler or HRSG and redirected to an intermediate pressure section 24, downstream of the high pressure section 22, as hot reheat steam.

Figure 3:
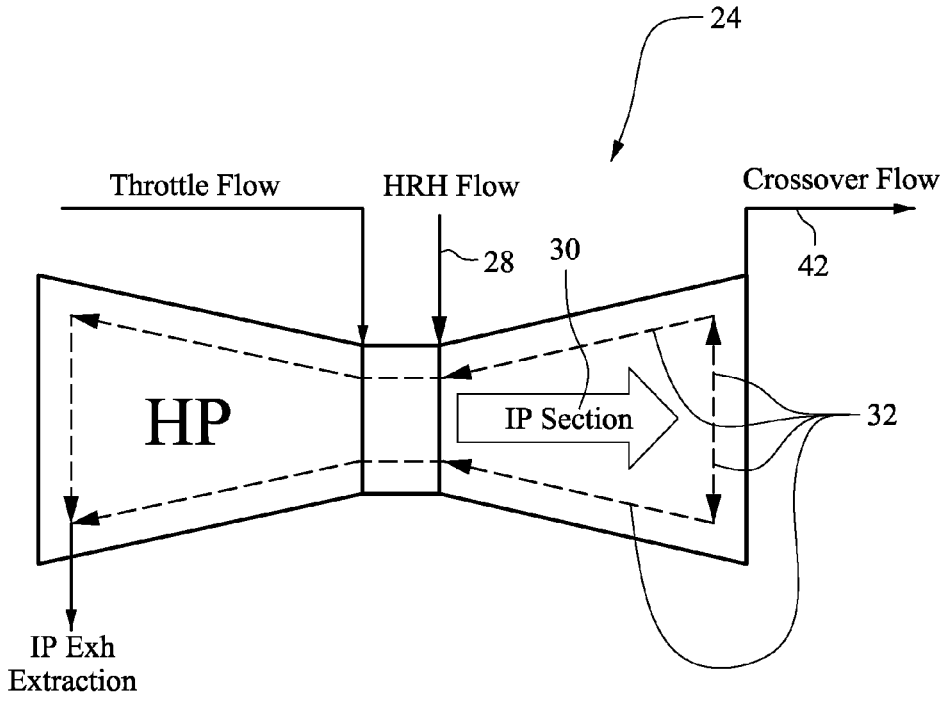
FIG. 3 is an enlarged schematic of the turbine IP section.

In the intermediate pressure section 24, a steam circuit includes a hot reheat steam input 28. With reference to FIG. 3, a first flow path of the steam circuit in the intermediate pressure section 24 flows the hot reheat steam from an HP side (left side in FIGS. 2 and 3) through the intermediate pressure section 24 to an LP side (right side in FIGS. 2 and 3) to create work. A second flow path 32 directs a portion of the flow back toward the HP side in the HP and IP sections 22, 24 between an outer shell and an inner shell of the turbine. The steam circuit also includes an IP exhaust extraction 34 directing flow from the second flow path 32 to an open feedwater heater or deaerator 36 (FIG. 2) or to a closed feedwater heater.

As shown in FIG. 2, the same circuit also includes an IP extraction 38 downstream of the hot reheat steam input 28 that receives partially expanded hot reheat steam and directs extracted steam to a different feedwater heater 40. A crossover flow path 42 directs input steam from the second flowpath 32 to a low pressure section 26 of the turbine.

The second flow path 32 defines a heat exchange path wherein the outer shell and inner shell of the turbine are cooled while the flow is heated. Waste heat in the space between the inner and outer shells can thus be recovered via the second flow path 32. The higher temperature steam can then be taken out of/extracted from the steam turbine via a flange or the like. As a consequence of the higher temperature steam in the IP exhaust extraction 34, a required amount of extraction flow can be reduced to reach the design final feedwater temperature. As a consequence, an additional amount of steam flow would be available for power generation in downstream stages of the steam turbine. This structure leads to increased generator output and reduced heat rate of the cycle.

The effective shell cooling according to preferred embodiments provide for increased main and reheat steam temperatures to improve performance. The system reduces the extraction steam flow required to meet the design final feedwater temperatures and allows more steam to expand through the low pressure section.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A steam turbine comprising:

a high pressure (HP) section;

an intermediate pressure (IP) section downstream of the high pressure section;

a low pressure (LP) section downstream of the intermediate pressure section; and a steam circuit through the high pressure, intermediate pressure, and low pressure sections, the steam circuit including:

a hot reheat steam input to the intermediate pressure section, a first flow path flowing the hot reheat steam from an HP side through the intermediate pressure section to an LP side to create work, and a second flow path that directs a portion of the flow back toward the HP side in the intermediate pressure section between an outer shell and an inner shell of the turbine.

2. A steam turbine according to claim 1, wherein the steam circuit further comprises an IP exhaust extraction from the second flow path to a first feedwater heater.

3. A steam turbine according to claim 2, wherein the steam circuit further comprises an IP extraction downstream of the hot reheat steam input that receives partially expanded hot reheat steam and directs extracted steam to a second feedwater heater.

4. A steam turbine according to claim 1, wherein the steam circuit further comprises a crossover flow path that directs input steam from the second flow path to the low pressure section.

5. A steam turbine according to claim 1, wherein the second flow path defines a heat exchange path wherein the outer shell and the inner shell of the turbine are cooled and wherein the flow is heated.

6. A steam circuit through a multi-section single shaft turbine, the steam circuit comprising:

a hot reheat steam input to a section of the multi-section turbine;

a first flow path flowing the hot reheat steam from an upstream side through the section of the multi-section turbine to a downstream side to create work; and a second flow path that directs a portion of the flow back toward the upstream side in the section of the multi-section turbine between an outer shell and an inner shell of the turbine.

7. A steam circuit according to claim 6, further comprising an IP exhaust extraction from the second flow path to a first feedwater heater.

8. A steam circuit according to claim 7, further comprising an IP extraction downstream of the hot reheat steam input that receives partially expanded hot reheat steam and directs extracted steam to a second feedwater heater.

9. A steam circuit according to claim 6, further comprising a crossover flow path that directs input steam from the second flow path to a downstream section of the turbine.

10. A steam circuit according to claim 6, wherein the second flow path defines a heat exchange path wherein the outer shell and the inner shell of the turbine are cooled and wherein the flow is heated.

11. A method of cooling an inner shell in a steam turbine using IP extraction flow, the method comprising:

directing a hot reheat steam input to an intermediate pressure section of the turbine;

flowing the hot reheat steam via a first flow path from an HP side through the intermediate pressure section to an LP side to create work; and directing a portion of the flow via a second flow path back toward the HP side in the intermediate pressure section between an outer shell and the inner shell of the turbine.

12. A method according to claim 11, further comprising extracting an IP exhaust from the second flow path to a first feedwater heater.

13. A method according to claim 12, further comprising extracting IP steam downstream of the hot reheat steam input via partially expanded hot reheat steam, and directing the extracted steam to a second feedwater heater.

14. A method according to claim 11, further comprising directing input steam from the second flow path to a low pressure section via a crossover flow path.

15. A method according to claim 11, wherein the step of directing the flow via the second flow path is practiced to cool at least the inner shell of the turbine and to heat the flow.

* * * * *